US007879447B2

(12) United States Patent
Novak et al.

(10) Patent No.: US 7,879,447 B2
(45) Date of Patent: Feb. 1, 2011

(54) UNDERWATER SAFETY SURFACE AND METHOD FOR PREPARING SAME

(75) Inventors: Jan C. Novak, Fairfax, VA (US); Vickie I. Novak, Fairfax, VA (US)

(73) Assignee: Jan Novak, Fairfax, VA (US)

( * ) Notice: Subject to any disclaimer, the term of this patent is extended or adjusted under 35 U.S.C. 154(b) by 973 days.

(21) Appl. No.: 11/695,674

(22) Filed: Apr. 3, 2007

(65) Prior Publication Data

US 2008/0244821 A1 Oct. 9, 2008

(51) Int. Cl.
*B32B 29/40* (2006.01)
*E04H 4/00* (2006.01)

(52) U.S. Cl. ..... 428/423.3; 428/423.1; 4/506

(58) Field of Classification Search ..... 428/423.1, 428/423.3; 4/506

See application file for complete search history.

(56) References Cited

U.S. PATENT DOCUMENTS 7,029,744 B2 * 4/2006 Horstman et al. ..... 428/143

* cited by examiner

*Primary Examiner*—Thao T. Tran
(74) *Attorney, Agent, or Firm*—George M. Tompkins; Tompkins P.C.

(57) ABSTRACT

The present invention is directed toward an underwater, safety surface and a method for preparing the same. The first layer of the surface consists of a typical existing swimming pool substrate. Next, a thin layer of flexible, breathable urethane primer is added. A thick layer of a mixture of rubberized particles bound by urethane is then applied. A final layer of thickened epoxy grout is then hand-troweled to ensure coverage between each of the rubberized particles. Finally, the epoxy grout is sanded, ground, and buffed to uncover the tips of the rubberized particles.

2 Claims, 1 Drawing Sheet

UNDERWATER SAFETY SURFACE AND METHOD FOR PREPARING SAME

BACKGROUND OF THE INVENTION

1. Field of the Invention

The present invention is directed toward a decorative, underwater, safety surface and a method for preparing the same. In particular, the present invention provides a slip resistant, impact resistant, chemical resistant, stain resistant, easily cleaned, flexible, durable, seamless, decorative surface that functions at varying levels of water coverage and a method for preparing the same.

2. Background Information

Swimming pool manufacturers have long desired the ability to produce a pool surface that is attractive, durable, chemically resistant, and safe for swimmers of all ages and abilities. To these ends, numerous surfaces and techniques have been developed in order to provide these characteristics to swimming and water play areas. However, until the development of the present invention, none have proven to provide the complete combination of characteristics necessary to fulfill the needs of the commercial swimming pool industry.

The typical, traditional swimming pool surface consists of plaster, gunite, or concrete. The benefits of these surfaces are many. Such surfaces are durable, and attractive. These pool surfaces are also fairly chemical resistant, but water chemistry must be carefully monitored in order to assure the longest possible life to the surface. However, these surfaces are clearly inadequate with regards to the issue of safety. First, these surfaces are extremely dense and hard; thus, any type of accident or fall can result in significant impact and injury to a swimmer. This is particularly significant with young swimmers who tend to play in shallow waters. Additionally, although when new, these surfaces are fairly slip resistant, over time the surfaces wear down and become extremely rough and abrasive to bare feet, resulting in scrapes and soreness from even a few minutes of play.

In an effort to improve upon these traditional pool and water play surfaces, numerous materials and combinations of materials have been developed. For instance, in order to decrease the density of the surface material, and thus reduce the likelihood of an impact injury, inventors have added a layer of rubber material to the pool or water play area surface. In doing so, this potential solution also contributed to another safety feature, slip resistance. However, although this attempt provided a naturally slip resistant surface, it remained inadequate in other important areas. Most significantly, the porous, rubberized surface tends to deteriorate and fail quickly due to its lack of chemical resistance.

Another development involves the use of epoxy coatings and substrates in combination with the above described rubberized surface in order to increase the chemical resistance and wear abilities of the surface. The various epoxies have been either mixed with the rubberized material and applied to traditional pool surfaces or solidly coated atop the rubberized layer. Either method fails to solve the ultimate problem because of the debilitating effect of vapor transmission between the traditional, underlying surface and the solid epoxy surface. This ultimately results in delamination of the epoxy coating from the rubberized surface or delamination of the epoxy/rubber substrate from the traditional underlying surface. Therefore, leaving the traditional pool surface itself with all of their associated drawbacks.

In view of the limitations of products currently known in the art, a tremendous need exists for an underwater safety surface that is attractive, seamless, durable, flexible, chemical resistant, impact resistant, and slip resistant. Applicant's invention, by its novel design and process for preparing it, provides such a solution in view of currently available surfaces.

SUMMARY OF THE INVENTION

In view of the foregoing, it is an object of the present invention to provide an underwater, safety surface that is attractive.

It is another object of the present invention to provide a process for preparing an underwater, safety surface that is attractive.

It is another object of the present invention to provide an underwater, safety surface that is seamless in appearance.

It is another object of the present invention to provide a process for preparing an underwater, safety surface that is seamless in appearance.

It is another object of the present invention to provide an underwater, safety surface that is durable.

It is another object of the present invention to provide a process for preparing an underwater, safety surface that is durable.

It is another object of the present invention to provide an underwater, safety surface that is flexible.

It is another object of the present invention to provide a process for preparing an underwater, safety surface that is flexible.

It is another object of the present invention to provide an underwater, safety surface that is extremely wear resistant.

It is another object of the present invention to provide a process for preparing an underwater, safety surface that is extremely wear resistant.

It is another object of the present invention to provide an underwater, safety surface that is extremely chemical resistant.

It is another object of the present invention to provide a process for preparing an underwater, safety surface that is extremely chemical resistant.

It is another object of the present invention to provide an underwater, safety surface that is extremely slip resistant in wet or dry conditions.

It is another object of the present invention to provide a process for preparing an underwater, safety surface that is extremely slip resistant in wet or dry conditions.

It is another object of the present invention to provide an underwater, safety surface that is impact resistant.

It is another object of the present invention to provide a process for preparing an underwater, safety surface that is impact resistant.

It is another object of the present invention to provide an underwater, safety surface that will perform its function above and below the water line and/or with very little water coverage without cracking or delaminating.

It is another object of the present invention to provide a process for preparing an underwater safety surface that will perform its function above and below the water line and/or with very little water coverage without cracking or delaminating.

It is another object of the present invention to provide an underwater, safety surface that is extremely stain resistant.

It is another object of the present invention to provide a process for preparing an underwater safety surface that is extremely stain resistant.

It is another object of the present invention to provide an underwater, safety surface that is extremely easy to keep clean without the need for aggressive scrubbing or power washing.

It is another object of the present invention to provide a process for preparing an underwater safety surface that is extremely easy to keep clean with the need for aggressive scrubbing or power washing.

It is another object of the present invention to provide an underwater safety surface that is resistant to metallic stains caused by corroding valves and piping, which is common for traditional swimming pool surfaces.

It is another object of the present invention to provide a process for preparing an underwater safety surface that is resistant to metallic stains caused by corroding valves and piping, which is common for traditional swimming pool surfaces.

It is another object of the present invention to provide an underwater safety surface that is UV resistant.

It is another object of the present invention to provide a process for preparing an underwater safety surface that is UV resistant.

It is another object of the present invention to provide an underwater safety surface that is freeze-and-thaw damage resistant.

It is another object of the present invention to provide a process for preparing an underwater safety surface that is freeze-and-thaw damage resistant.

It is another object of the present invention to provide an underwater safety surface that is resistant to calcium deposits.

It is another object of the present invention to provide to provide a process for preparing an underwater safety surface that is resistant to calcium deposits.

It is another object of the present invention to provide an underwater safety surface that can be renewed to its original appearance, at a fraction of the original cost, without the need of replacing the entire system or excessive preparation.

It is another object of the present invention to provide a process for preparing an underwater safety surface that can be renewed to its original appearance, at a fraction of the original cost, without the need of replacing the entire system or excessive preparation.

It is another object of the present invention to provide an underwater safety surface that can be repaired seamlessly.

It is another object of the present invention to provide a process for preparing an underwater safety surface that can be repaired seamlessly.

It is another object of the present invention to provide an underwater safety surface in which repairs that have been made are difficult to detect with the naked eye.

It is another object of the present invention to provide a process for preparing an underwater safety surface in which repairs that have been made are difficult to detect with the naked eye.

In satisfaction of these and other related objects, the present invention provides an underwater, safety surface and process for preparing the same. Furthermore, the device and method of the present invention incorporates a rubberized layer and an epoxy layer applied and finished in such a fashion as to produce a surface that is attractive, durable, chemical resistant, and slip resistant.

The process of the present invention begins with a traditional, existing swimming pool substrate, such as swimming pool plaster, gunite or concrete. Each of these surfaces are naturally breathable, which results in the allowance of vapor transmission and dissipation. This existing surface is coated with a thin layer of urethane primer, also a naturally breathable and flexible material. A thick coating of a mixture containing colored, rubberized particles and urethane is then hand troweled onto the existing surface; thus, at this stage, the system is still exclusively composed of breathable materials. Next, a chemical resistant paint-like material is processed to significantly increase its viscosity. This epoxy mixture is then grouted onto the rubber mixture with enough pressure to ensure penetration between the rubber particles. Finally, the surface is sanded, ground, and buffed to remove a thin layer of the epoxy, uncovering the tips of the rubberized particles, while leaving the bulk of the epoxy that has penetrated between the rubber particles to act as a protective grout/sealant. Thus, the process results in a surface combining the decorative color and slip resistance of the exposed rubberized particles and the chemical resistance and durability of the epoxy coating. Most significantly, due to the thickness of the surface, vapor transmission from the underlying substrate disburses itself under the system and through the tips of the exposed rubberized particles, without delaminating the non-porous chemical resistant grout, resulting in the prevention of premature failure of the underwater, safety surface.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
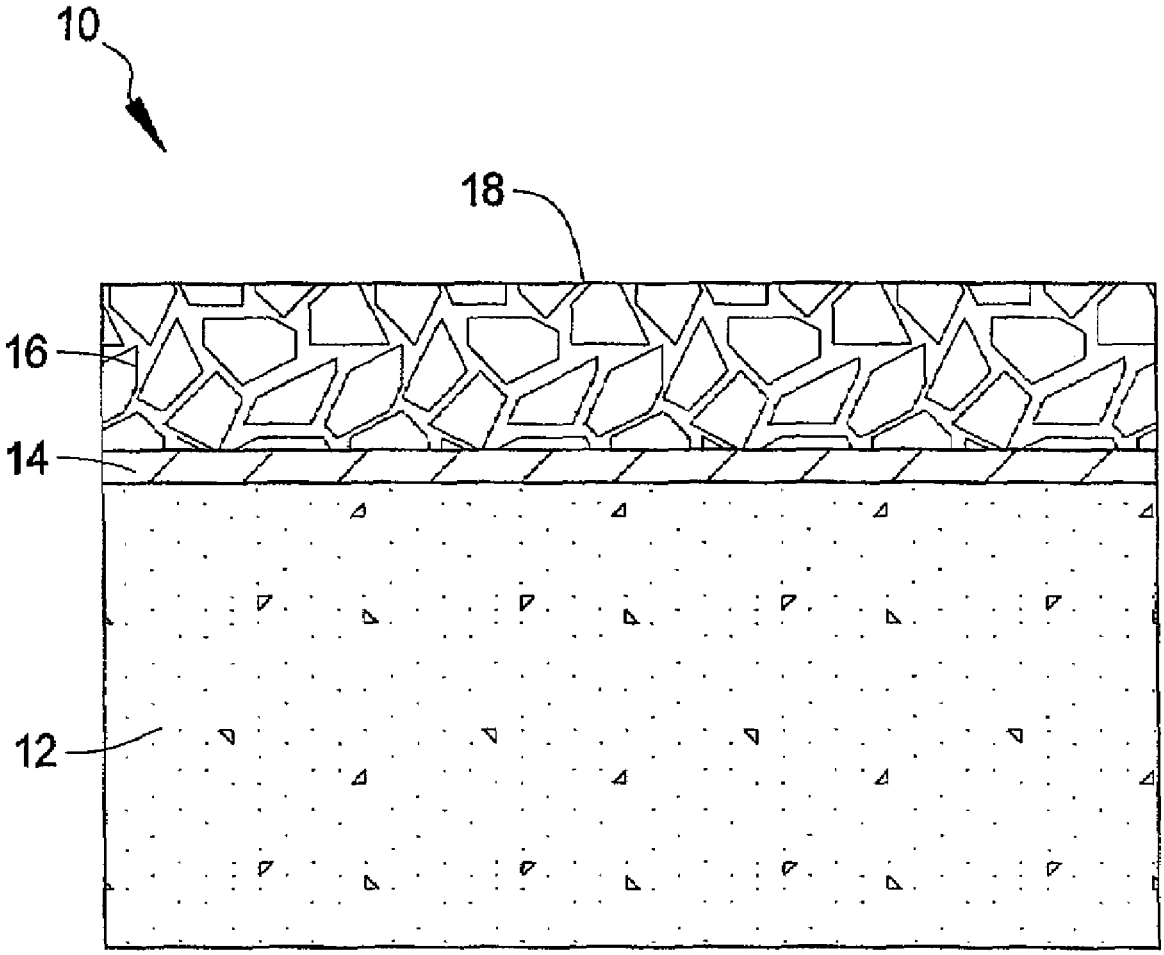
FIG. 1 is a cross sectional view of the surface of the present invention.

Referring to FIG. 1, an underwater, safety surface is shown and generally designated by numeral 10. Surface (10) is comprised of four basic layers of material processed in four essential steps. The bottommost layer is the existing breathable substrate (12), typically, swimming pool plaster, gunite, or concrete. To substrate (12), a thin layer of urethane primer (14) is applied. In the preferred embodiment, the urethane primer (14) is applied at 1 mil to 10 mil. Next, a thick layer of mixture (16) is applied to the surface via a hand-troweling process to ensure appropriate, seamless coverage. In the preferred embodiment, mixture (16) is applied at a minimum thickness of ⅜ inches. Mixture (16) is composed of particles of a rubberized material and a urethane binder. In the preferred embodiment, the rubberized material consists of colored "virgin" EPDM particles ranging from 1 mm to 4 mm in size. The urethane works as a binder in order to hold the rubberized material together.

Epoxy grout (18) is then hand-troweled onto the surface with sufficient pressure to ensure penetration between the rubberized particles of mixture (16). In the preferred embodiment, epoxy grout is applied at approximately 20 mils. In the preferred embodiment, epoxy grout (18) is produced by thickening a chemical resistant paint-like material with a thickening agent. Finally, epoxy grout (18) is sanded, ground, and buffed to remove enough epoxy grout (18) to expose the tips of the rubberized material of mixture (16), while leaving the remaining epoxy grout (18) as a protective coating. Thus, the aesthetic and slip resistant properties of the rubberized material combine with the durability and chemical resistant properties of the epoxy to provide an underwater, safety surface superior to any currently known surface. Most significantly, the breathability of the surface, from the traditional pool surface through the rubberized material tips, prevents vapor buildup, resulting in a tightly bonded surface that resists the problem of delamination, currently present in all other known systems involving rubberized material in combination with epoxy coatings.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

We claim:

1. An underwater safety surface, comprising:

a first layer of material, said first layer being comprised of a breathable substrate material;

a second layer of material juxtaposed said first layer of material, said second layer being a thin layer of urethane primer;

a third layer of material juxtaposed said second layer of material, said third layer being a thick mixture comprising particles of a rubberized material intermixed throughout a urethane binder; and a fourth layer of material juxtaposed said third layer of material, said fourth layer being an epoxy grout, said fourth layer of material being finished such that the tips of said particles of said rubberized material are exposed.

2. A process for preparing an underwater safety surface, comprising the steps of:

applying a first layer of material, said first layer of material being comprised of a breathable substrate material;

applying a thin second layer of material to said first layer of material, said second layer of material being a urethane primer;

applying a thick third layer of material to said second layer of material, said third layer of material being a thick mixture comprising particles of rubberized material intermixed throughout a urethane binder, said third layer of material being applied via a troweling technique;

applying a fourth layer of material to said third layer of material, said fourth layer of material being an epoxy grout, said fourth layer of material being applied via a troweling technique to ensure penetration between said particles of said rubberized material of said third layer; and sanding, grounding, and buffing said fourth layer to remove enough of said fourth layer to expose the tips of said rubberized particles of said third layer, while leaving the remaining said epoxy grout of said fourth layer as a protective coating.

* * * * *